United States Patent [19]

Duff

[11] 4,363,258

[45] Dec. 14, 1982

[54] HYDRAULIC IMPACTOR

[75] Inventor: John Duff, Corbeil, Canada

[73] Assignee: Joy Manufacturing Company, Pittsburgh, Pa.

[21] Appl. No.: 141,023

[22] Filed: Apr. 17, 1980

[51] Int. Cl.[3] ..... F01L 17/00; F01L 25/04

[52] U.S. Cl. ..... 91/165; 91/276; 91/290; 92/134

[58] Field of Search ..... 92/134; 91/276, 321, 91/165, 290

[56] References Cited

U.S. PATENT DOCUMENTS

| | | | |
|---|---|---|---|
| 1,593,606 | 7/1926 | Slater | 91/276 |
| 3,925,985 | 12/1975 | Peterson | 92/134 |
| 3,965,799 | 6/1976 | Juvonen et al. | 91/276 |
| 4,011,795 | 3/1977 | Borthe et al. | 92/134 |
| 4,022,108 | 5/1977 | Juvonen | 91/276 |
| 4,103,591 | 8/1978 | Reiersdol | 92/134 |

*Primary Examiner*—Paul E. Maslousky

*Attorney, Agent, or Firm*—Buell, Blenko, Ziesenheim & Beck

[57] ABSTRACT

An all-hydraulic impactor for percussion tools and the like embodying an oil accumulator and an annular sleeve valve. Hydraulic fluid is initially supplied to the accumulator at full supply pressure and is then charged, for example, to three times the supply pressure by a differential piston arrangement. The impactor of the invention minimizes the required volume of the accumulator.

7 Claims, 7 Drawing Figures

HYDRAULIC IMPACTOR

BACKGROUND OF THE INVENTION

While not limited thereto, the present invention is particularly adapted for use with percussion tools such as fluid-operated hammers used in the construction and mining industries. In a hammer of this type, a piston is initially forced upwardly to compress a fluid in an accumulator chamber. Suitable valving then releases pressure from the underside of the piston, whereupon the stored energy of the compressed fluid in the accumulator forces the piston downwardly to impact against an anvil or the like.

In the past, most fluid-operated hammers of this type have utilized a gas accumulator. Hydraulic accumulators have also been proposed but such hydraulic accumulators heretofore have been quite large owing to the stiffness (bulk modulus) of the hydraulic fluid. As a consequence, and because of the large size of the required accumulator, all-hydraulic impactors have not found widespread use.

SUMMARY OF THE INVENTION

In accordance with the present invention, an all-hydraulic impactor of the type described above is provided in which differential piston areas are employed to reduce the size of the required hydraulic accumulator. In this respect, for a given fluid and blow energy, the required volume of the accumulator varies as the inverse maximum accumulator pressure squared. Consequently, an advantage is gained by initially supplying hydraulic fluid to the accumulator at full supply pressure and then employing the differential area ratio of the piston to charge the accumulator to several times the supply pressure. If, for example, the differential area ratio of the piston is 3:1, the accumulator will be charged to three times the supply pressure and the required accumulator volume will be one-ninth that which would otherwise be required.

Specifically, there is provided in accordance with the invention a hydraulic impactor including a cylinder having a differential area piston reciprocable therein. The piston has a large diameter central portion and reduced-diameter shank portions extending axially from its opposite ends, one of the shank portions being adapted to impart an impact to an anvil element and the other shank portion being adapted to slide into a hydraulic accumulator to compress a liquid therein. A sleeve valve surrounds the piston and connects a source of liquid under pressure to the face of the large diameter piston portion opposite the accumulator when the piston moves to a position where it is furthest removed from the accumulator. When the piston moves to a position where it is closest to the accumulator, the sleeve valve connects the face of the large diameter piston portion opposite the accumulator to a low pressure reservoir in the hydraulic system such that the compressed fluid within the accumulator will then force the piston toward an anvil or the like to impact the same. Advantageously, the piston does not actually contact the anvil but rather imparts an impact by compressing a fluid in a high pressure chamber into which the anvil extends.

The above and other objects and features of the invention will become apparent from the following detailed description taken in connection with the accompanying drawings which form a part of this specification, and in which.

Figure 1:
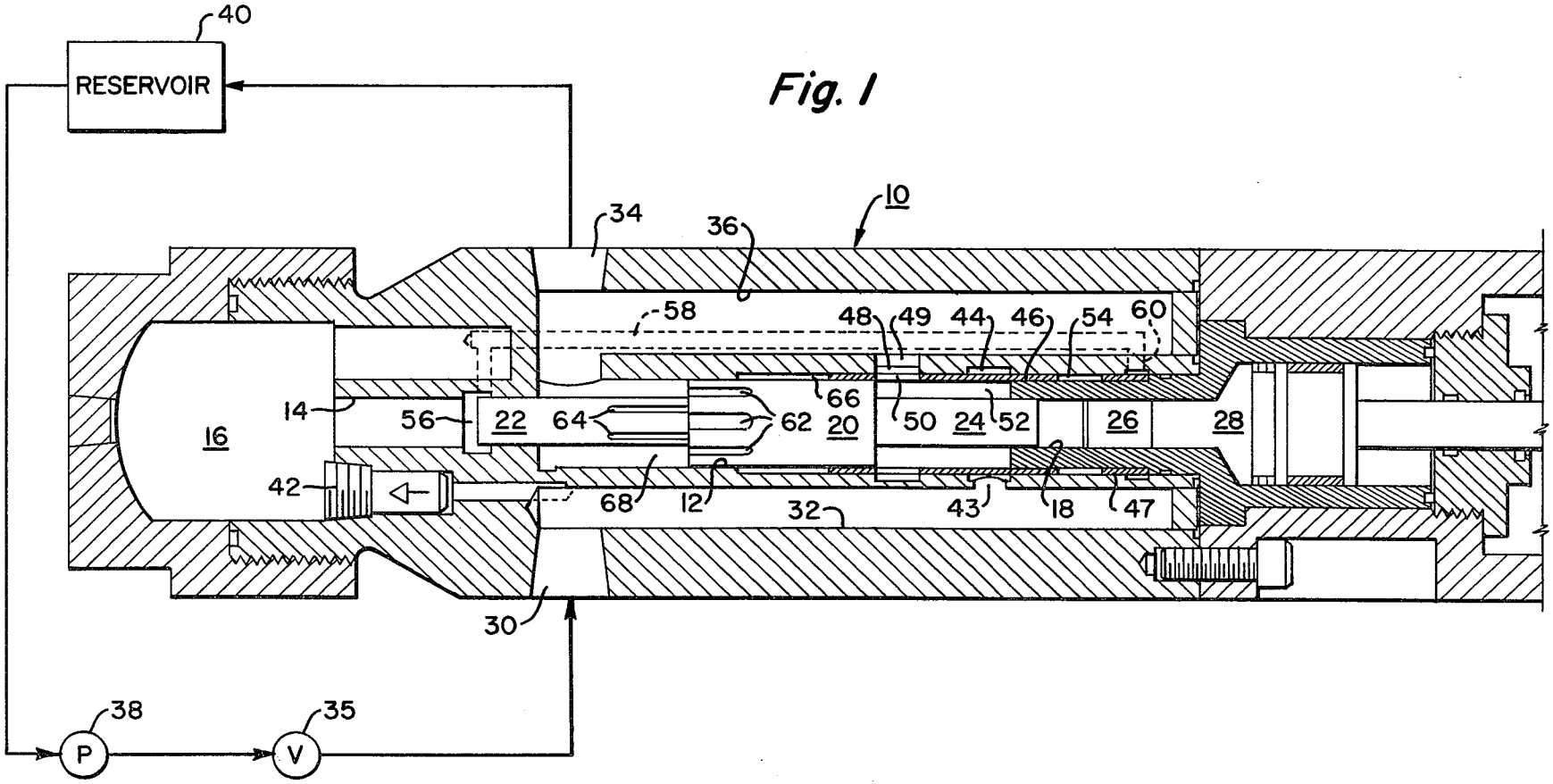
FIG. 1 is a cross-sectional view of the hydraulic impactor of the invention.

With reference now to the drawings, and particularly to FIG. 1, the impactor shown includes an outer casing 10 having bored therein a large diameter cylinder portion 12 which communicates with a small diameter cylinder portion 14. The cylinder portion 14, in turn, communicates with an accumulator chamber 16. At the opposite end of the large diameter cylinder portion 12 is a second small diameter cylinder portion 18. Reciprocable within the cylinder portion 12 is a large diameter piston portion 20 having smaller diameter shank portions 22 and 24 projecting from its opposite ends. Piston portion 22 is reciprocable within the small diameter cylinder portion 14 and, when it moves to the left as viewed in FIG. 1, will compress liquid within the accumulator chamber 16. The small diameter piston portion 24, on the other hand, is adapted to enter cylinder portion 18 which forms a high pressure chamber 26. At the other end of the high pressure chamber 26 is a reciprocable anvil 28 which, in turn, is adapted to strike a tool, not shown, such as a chisel, a spade or moil. As will be seen, when the piston portion 24 enters the cylinder portion 18, which is filled with liquid, it imparts an impact to the anvil 28 which, in turn, imparts an impact to the aforesaid tool, not shown.

Formed in the wall of the housing 10 is an inlet port 30 which communicates with a bore 32 formed in the housing. An outlet port 34 communicates with a second longitudinally-extending bore 36 also formed in the housing 10. The inlet port 30 may be connected through valve 35 to the outlet port of a pump 38; while the outlet port 34 is connected to a fluid reservoir 40 which, in turn, is connected to the inlet port of the pump 38. Between the bore 32 and the accumulator chamber 16 is a check valve 42 which permits fluid flow from the bore 32 into the chamber 16 but does not permit reverse flow. The bore 32 is also connected via radial bores 43 to an annulus 44 surrounding a cylindrical sleeve valve 46. The sleeve valve 46, in turn, is adapted to slide on the outer periphery of the large diameter piston portion 20 and fits into an annular space 47 formed in housing 10 and surrounding the chamber 26. A second annulus 48 surrounding the sleeve 46 is connected as shown by radial bores 49 to the bore 36 and, hence, to the outlet port 34. As will hereinafter be explained, the sleeve valve 46 can slide from the position shown in FIG. 1 to the left and vice versa. In the position shown, openings 50 in the wall of the sleeve valve 46 connect chamber 52 on the right side of the large diameter piston portion 20 to the outlet bore 36. In the other position of the sleeve valve, openings 54 connect the chamber 52 to the inlet bore 32.

The small diameter cylinder portion 14 is provided with a surrounding annulus 56 which is connected through bore 58 in the housing 10 and port 60 to the lower edge of the sleeve valve 46. As will be seen, with the small diameter piston portion 22 in the position shown in FIG. 1, fluid under pressure from the accumulator chamber 16 will flow through bore 58 and port 60 to the underside of the sleeve 46 to move it to the left, thereby registering openings 54 with the annulus 44 such that the chamber 52 is connected to the inlet bore 32.

The left end of the large diameter piston portion 20 and the right end of the small diameter piston portion 22 have peripheries provided with axially-extending slots 62 and 64, respectively. In the position of the piston shown, the slots 62 connect the space 66 above the sleeve valve 46 to the exhaust port 34. Slots 64 connect passageway 58 to the exhaust port 34 when the piston has reached its extreme leftward limit of travel as viewed in FIG. 1.

Figures 2A, 2B, 2C:
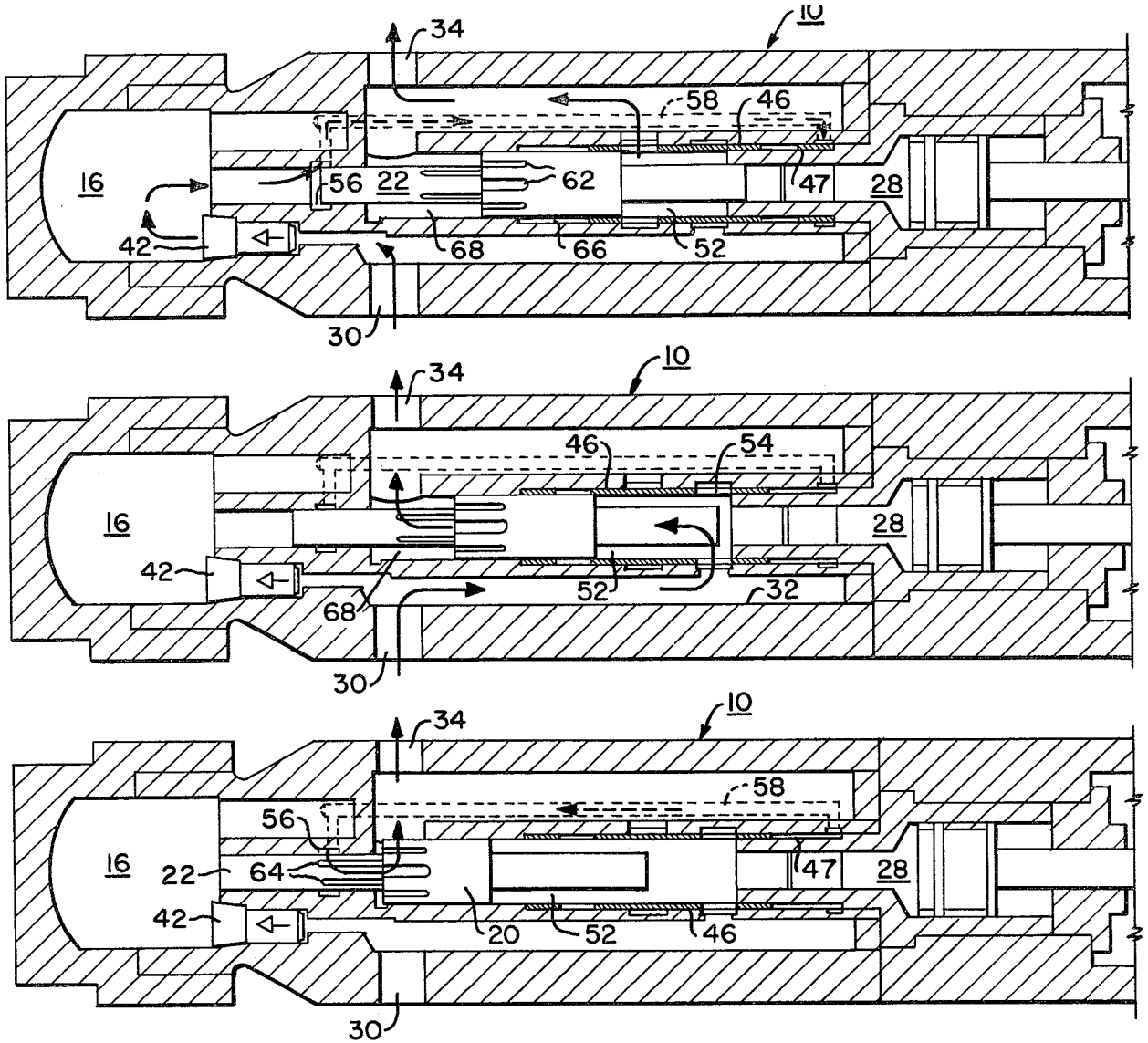
FIGS. 2A through 2E are cross-sectional views, similar to that of FIG. 1, which show various portions of the piston within the impactor of the invention.

Operation of the impactor can best be understood by reference to FIGS. 2A–2E. In FIG. 2A, the piston within the cylinder portions has just been forced to the right and has impacted the anvil 28. At this point, the left end of the small diameter piston portion 22 has cleared the upper edge of the annulus 56, thereby connecting fluid under pressure in the accumulator chamber 16 through passageway 58 to the lower edge of the sleeve valve 46 in annular space 47. The accumulator chamber 16 is maintained at the supply pressure by virtue of the check valve 42 which permits liquid to flow into the chamber. At the same time, the slots 62 in the large diameter piston portion 20 connect the space or annulus 66 to the left of the sleeve valve 46 through chamber 68 to the exhaust port 34. The result is that fluid under pressure in bore 58 forces the sleeve valve 46 from its position shown in FIG. 2A to the position shown in FIG. 2B where openings 54 in the sleeve valve now connect the inlet bore 32 to chamber 52. Fluid under pressure in chamber 52 now forces the piston to the left as shown in FIG. 2B with the fluid in chamber 68 being exhausted through exhaust port 34.

When the piston reaches the position shown in FIG. 2C, slots 64 in the small diameter piston portion 22 connect the annulus 56 to the exhaust port 34 and, hence, connect the lower edge of the sleeve valve 46 to the exhaust port through bore 58. At the same time, the right edge of the large diameter piston portion 20 has just cleared the left edge of the sleeve valve 46 whereby the supply pressure in chamber 52 forces the sleeve valve to the right with the fluid to the right of the sleeve valve in space 47 being exhausted through bore 58, slots 64 and exhaust port 34.

Figure 2D:
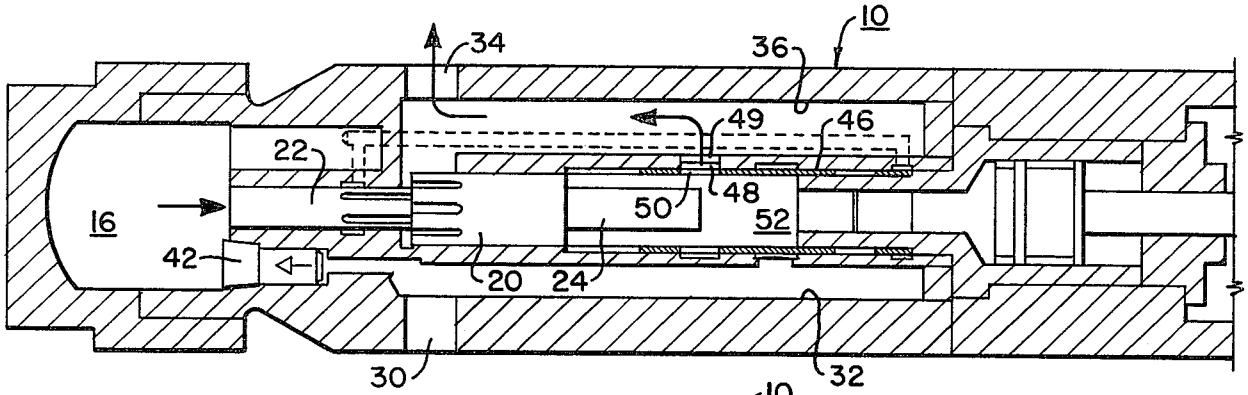
Figure 2E:
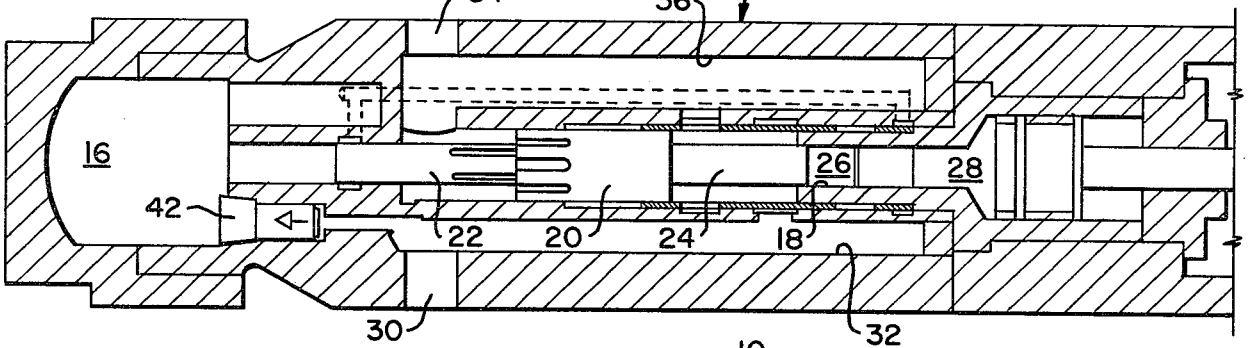

The sleeve valve now assumes the position shown in FIG. 2D where inlet bore 32 is disconnected from chamber 52 and outlet bore 36 is connected through radial openings 49, annulus 48 and openings 50 to the chamber 52 such that the fluid within chamber 52 can be exhausted through exhaust port 34. Fluid under pressure in the accumulator chamber 16 now acts on the left end of the piston portion 22, forcing the piston to the right and into the position shown in FIG. 2E where it impacts against the fluid in chamber 26, this impact being transmitted to the anvil 28.

As the piston begins its movement to the left to compress fluid within the accumulator chamber 16, only the right side of the enlarged diameter piston portion 20 is subjected to the pressure. However, once the right end of the reduced-diameter piston portion 24 leaves cylinder portion 18, the entire area of piston portions 20 and 24 is subject to supply pressure, this area being, for example, about three times the area of the left end of piston portion 22.

It can be shown that the required volume of the accumulator chamber 16 is proportional to:

$$(\beta E)/P^2)$$

where $\beta$ is the effective bulk modulus of the liquid in the accumulator, P is the pressure within the chamber and E is the energy stored in the container and is equal to $\frac{1}{2}$ FX, where F is the force exerted by the piston in moving through a distance X. Prior art machines employing hydraulic accumulators have suffered from excessively large accumulator volumes. This is because the effective bulk modulus of a liquid is on the order of 180,000 to 300,000 pounds per square inch, a typical figure for hydraulic oil being about 200,000 pounds per square inch. Furthermore, energies required by impactors range from 500 to 5000 foot pounds. A 1000 foot pound machine would be at the low end of the range. Typical pressure levels used in hydraulic systems range from 150 pounds per square inch to 5000 pounds per square inch with 3000 pounds per square inch being the usual upper level for current systems for hydraulic drills.

The mathematical relationship given above states that the volume of the accumulator chamber will increase in direct proportion to an increase in either the bulk modulus or in the blow energy E required by the machine. However, the volume will decrease at the rate of the pressure squared. This pressure is effectively increased in accordance with the present invention by utilizing the differential piston areas such that the entire areas of piston portions 20 and 24 are exposed to the supply pressure; and the resulting force acts on a much smaller area in small diameter cylinder portion 14.

Figure 3:
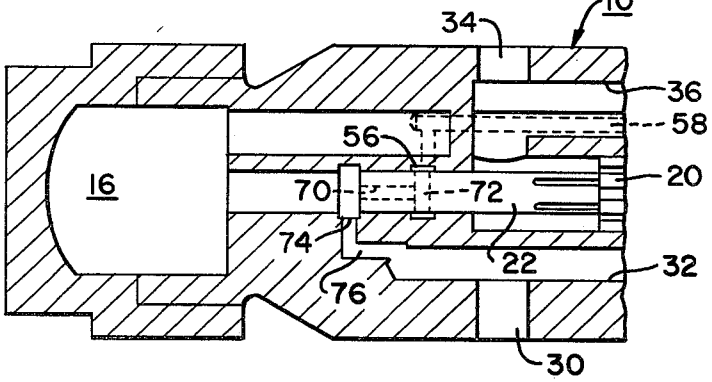
FIG. 3 is a cross-sectional view of an alternative embodiment of the invention.

In FIG. 3, an alternative embodiment of the invention is shown which is similar to that of FIG. 1. In this case, however, the check valve 42 is eliminated. Furthermore, the reduced-diameter piston portion 22 is provided with an internal bore 70 which communicates with radial bores 72. In the extreme rightward limit of travel of the piston shown in FIG. 3, the radial bores 72 register with the annulus 56, thereby connecting the accumulator 16 through passageway 58 to the bottom of the sleeve valve 46 shown in FIG. 1 to shift it to the left. At the same time, in the extreme rightward limit of travel shown in FIG. 3, the upper end of the reduced-diameter piston portion 22 passes the upper edge of an annulus 74. The annulus 74, in turn, is connected through bore 76 to the inlet bore 32 such that the accumulator chamber 16 is subjected to supply pressure in the extreme rightward position of the piston just as it is in the embodiment of FIG. 1. Aside from this, the operation of the embodiment of FIG. 3 is the same as that of FIG. 1.

Although the invention has been shown in connection with certain specific embodiments, it will be readily apparent to those skilled in the art that various changes in form and arrangement of parts may be made to suit requirements without departing from the spirit and scope of the invention. In this regard, the right end or face of the shank portion 24 need not be exposed in liquid under pressure during leftward movement of the piston as shown in FIG. 1, provided that the annular area of portion 20 surrounding shank portion 24 is greater than the cross-sectional area of shank portion 22. In this case, the shank portion 24 will have to be longer than that shown in FIG. 1 such that it does not leave cylinder portion 18 during leftward movement of the piston.

I claim as my invention:

1. A hydraulic impactor comprising:

a cylinder, a hydraulic accumulator at one end of said cylinder, a differential area piston reciprocable within said cylinder, said piston having a large diameter central portion and reduced-diameter shank portions extending axially from its opposite sides, said piston large diameter central portion having a first annular face at one end and a second annular face at the other end with said second annular face being disposed closer to said hydraulic accumulator than is said first annular face, a first one of said shank portions being adapted to impart an impact to an anvil element, a second of said shank portions being adapted to slide into said hydraulic accumulator to compress a fluid therein, a sleeve valve surrounding said piston and reciprocable along the axis of said cylinder, means responsive to movement of said piston to a position where it is farthest removed from said accumulator for moving said sleeve valve to a position where it connects a source of liquid under pressure to said first annular face of said large diameter piston portion, means responsive to movement of said piston to a position where it is closest to said accumulator for moving said sleeve valve to a position where it connects said first annular face of said large diameter piston portion to a hydraulic reservoir, means for causing said liquid under pressure to act on the total area of said first annular face of said large diameter piston portion and said first shank portion during movement of said piston toward said accumulator and said second shank portion being reciprocable within a cylindrical bore and having an area less than that of the combined areas of said first annular face of said large diameter piston portion and first shank portion.

2. The hydraulic impactor of claim 1 including a first annulus surrounding said sleeve valve and connected to said source of liquid under pressure, a second annulus surrounding said sleeve valve and connected to said hydraulic reservoir, and openings in said sleeve valve adapted to register with said first and second annuli.

3. The hydraulic impactor of claim 1 including check valve means for connecting said accumulator to said source of liquid under pressure and acting to permit the flow of fluid from said source into said accumulator.

4. The hydraulic impactor of claim 1 including slot means on said second shank portion at its end opposite said accumulator for connecting one end of said sleeve valve to said reservoir when the piston is closest to said accumulator.

5. The hydraulic impactor of claim 1 including slot means in the periphery of said large diameter central piston portion at its end closest to said accumulator for connecting an end of said sleeve valve to said reservoir when the piston is farthest removed from said accumulator.

6. The hydraulic impactor of claim 1 including an axial bore in said second shank portion for connecting said source of liquid under pressure to said sleeve valve when the piston is in its position farthest removed from said accumulator and permitting generally simultaneous connection between said source of liquid under pressure and said accumulator.

7. The hydraulic impactor of claim 1 wherein the area of said first annular face of said large diameter portion surrounding said first shank portion is greater than the cross-sectional area of the free end of said second shank portion.

* * * * *